US008801542B2

(12) United States Patent
Sugimoto

(10) Patent No.: US 8,801,542 B2
(45) Date of Patent: Aug. 12, 2014

(54) GOLF CLUB

(75) Inventor: Yasushi Sugimoto, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 367 days.

(21) Appl. No.: 13/243,248

(22) Filed: Sep. 23, 2011

(65) Prior Publication Data

US 2012/0108358 A1 May 3, 2012

(30) Foreign Application Priority Data

Oct. 28, 2010 (JP) ..... 2010-242406

(51) Int. Cl.
*A63B 53/08* (2006.01)
*A63B 53/04* (2006.01)

(52) U.S. Cl.
USPC ..... 473/345; 473/316; 473/346; 473/349

(58) Field of Classification Search
USPC ..... 473/316, 345, 346, 349
See application file for complete search history.

(56) References Cited

U.S. PATENT DOCUMENTS

| | | | | |
|---|---|---|---|---|
| 7,303,487 | B2 * | 12/2007 | Kumamoto | 473/345 |
| 7,510,485 | B2 * | 3/2009 | Yamamoto | 473/345 |
| 2006/0073910 | A1 | 4/2006 | Imamoto et al. | |
| 2006/0100032 | A1 | 5/2006 | Imamoto et al. | |
| 2006/0116217 | A1 | 6/2006 | Oyama | |
| 2006/0172820 | A1 * | 8/2006 | Kouno et al. | 473/345 |

FOREIGN PATENT DOCUMENTS

JP 2004105217 A * 4/2004

* cited by examiner

*Primary Examiner* — Benjamin Layno
(74) *Attorney, Agent, or Firm* — Birch, Stewart, Kolasch & Birch, LLP

(57) ABSTRACT

A golf club comprises a club shaft and a golf club head attached to the tip end of the club shaft, wherein the length of the golf club is from 45 to 47 inches, the volume V of the golf club head is from 440 to 470 cu·cm, the moment of inertia M of the golf club head around the center line of the club shaft is 5500 to 6500 g sq·cm, and the ratio M/V of the moment of inertia M (g sq·cm) to the volume V (cu·cm) is from 11.0 to 13.5.

11 Claims, 6 Drawing Sheets

GOLF CLUB

BACKGROUND OF THE INVENTION

The present invention relates to a golf club, more particularly to a hollow structure of the golf club head capable of improving the directional stability and carry distance of the ball.

In order to increase the carry distance of the ball by increasing the golf club head speed, the use of relatively long clubs became popular in recent years.

In the case of such long golf clubs, however, there is a tendency that ball hitting positions vary widely and it is difficult to hit the ball at the sweet area. As a result, contrary to expectation, increased carry distance can not be obtained steadily. Therefore, the golf club head of such a long golf club is also increased in the volume in order to widen the sweet area.

In the case of such large-sized golf club head, there is a tendency that the moment of inertia of the club head around the center line of the club shaft increases. Therefore, during swing, the club face is hard to return to the proper address position due to the large moment, and the golfer tends to make a slice shot.

SUMMARY OF THE INVENTION

It is therefore, an object of the present invention to provide a golf club in which, in spite of a relatively long club with a large-sized club head, by specifically limiting the club length, the head volume and the moment of inertia, the directional stability of the ball is improved and the increased carry distance can be obtained steadily.

According to the present invention, a golf club comprises a club shaft and a golf club head attached to the tip end of the club shaft, wherein the length of the golf club is in a range of from 45 to 47 inches, the volume V of the golf club head is in a range of from 440 to 470 cu·cm, the moment of inertia M of the golf club head around the center line of the club shaft is in a range of from 5500 to 6500 g sq·cm, the ratio M/V of the moment of inertia M (g sq·cm) to the volume V (cu·cm) is in a range of from 11.0 to 13.5.

Therefore, owing to the relatively long club length of 45 to 47 inches, the head speed is increased and the carry distance can be increased.

Further, owing to the relatively large head volume of 440 to 470 cu·cm, the sweet area becomes wider. Therefore, even if the ball hitting positions vary, the variations of the carry distance are decreased.

Furthermore, owing to the moment of inertia limited in a specific range and further limited in relation to the head volume, in spite of the large head volume, the moment of inertia becomes relatively small, therefore, during swing, the club face can return to the proper address position easily, and slice or hook shots can be avoided. Accordingly, the directional stability is improved and thereby the carry distance can be increased.

In this application including the specification and claims, sizes, positions, directions and the like relating to the club head refer to those under a standard state of the club head unless otherwise noted.

The standard state of the club head is such that the club head is set on a horizontal plane HP so that the center line CL of the club shaft is inclined at the lie angle (alpha) while keeping the club shaft center line CL on a vertical plane VP, and the club face (at the sweet spot) forms its loft angle (beta) with respect to the horizontal plane HP. Incidentally, in the case of the club head alone, the center line of the club shaft inserting hole can be used instead of the center line of the club shaft.

The sweet spot SS is the point of intersection between the club face and a straight line n drawn normally to the club face passing the center of gravity G of the head.

The undermentioned front-back direction is a direction parallel with the above-mentioned straight line n projected on the horizontal plane HP.

The undermentioned heel-and-toe direction is a direction parallel with the horizontal plane HP and perpendicular to the front-back direction.

The club length L is defined, in the standard state, as the length between the butt end of the club shaft and the intersecting point P of the club shaft center line CL with the horizontal plane HP.

The value of the moment of inertia M is that of the golf club head alone, namely, the club shaft and a ferrule (socket) if any are removed, but the coating of paint is not removed.

BRIEF DESCRIPTION OF THE DRAWINGS

FIG. 6(*b*) is a side view thereof viewed from the toe-side.

FIG. 7(*b*) is a side view thereof viewed from the toe-side.

DESCRIPTION OF THE PREFERRED EMBODIMENTS

Taking a wood-type golf club as an example, embodiments of the present invention will now be described in detail in conjunction with accompanying drawings.

Here, the wood-type golf club means at least number 1 to 5 woods, and clubs comprising heads having similar shapes thereto may be included.

Figure 1:
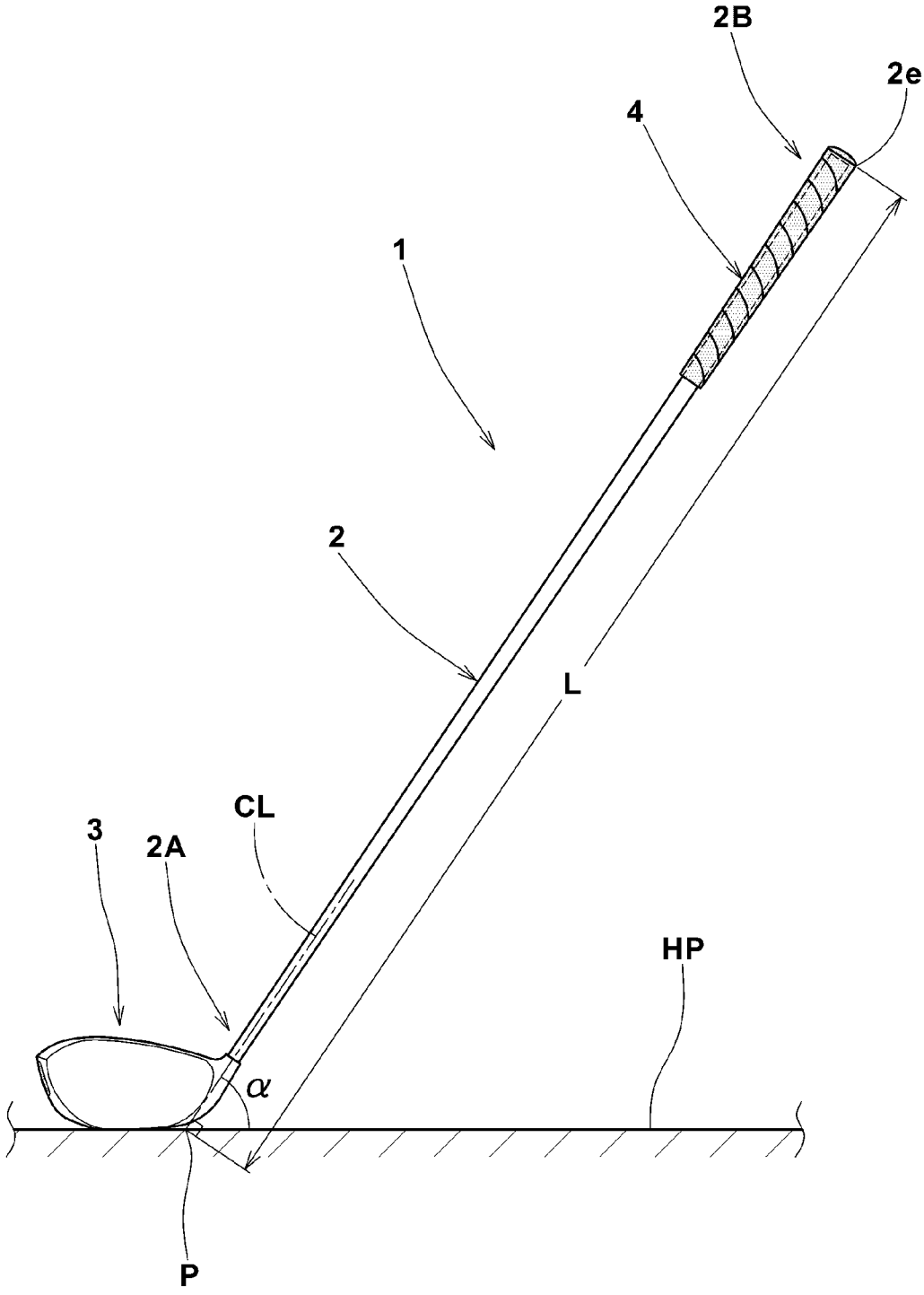
FIG. 1 is a front view of a golf club according to an embodiment of the present invention in the standard state.
Figure 2:
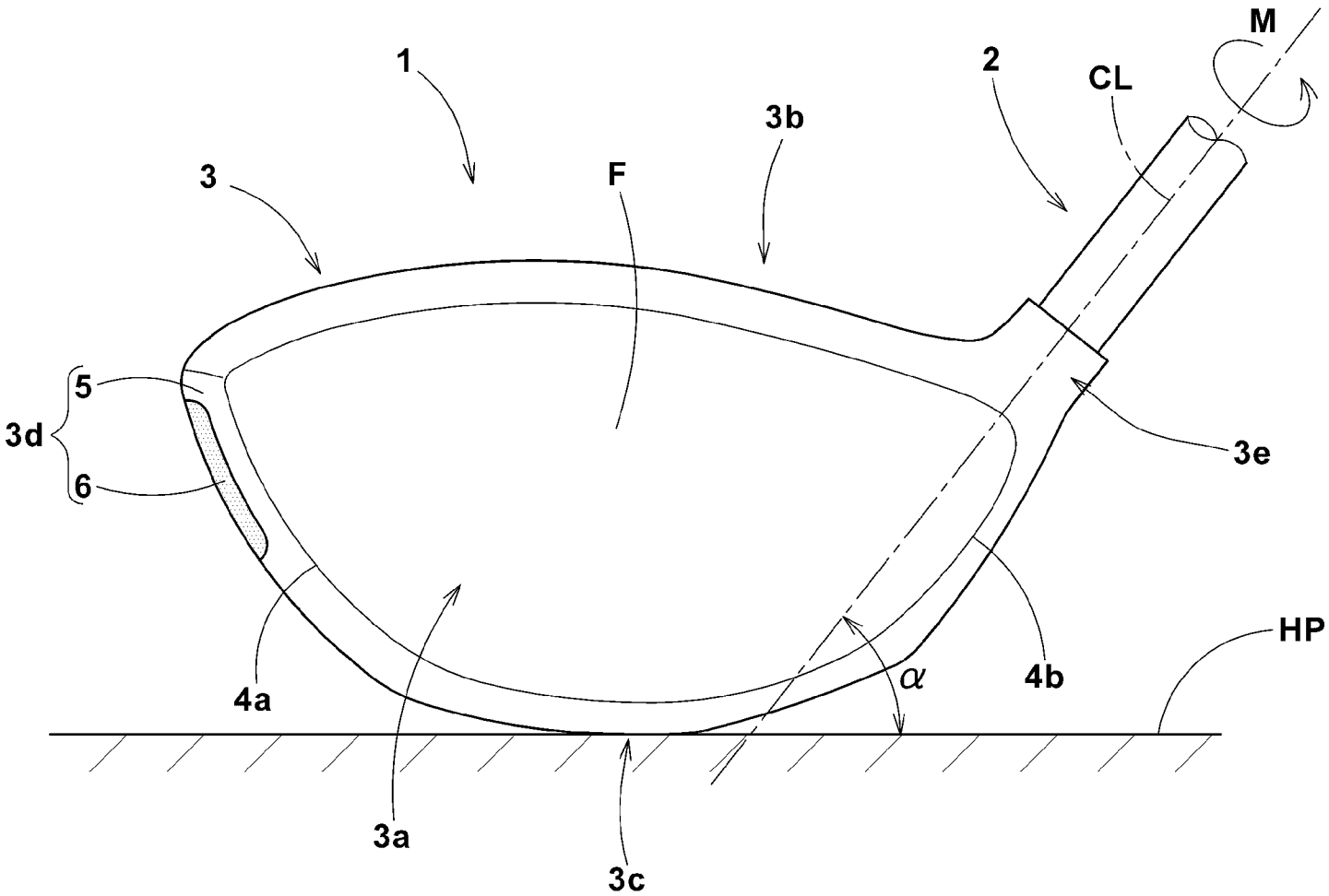
FIG. 2 is a front view of the golf club head thereof.
Figure 3:
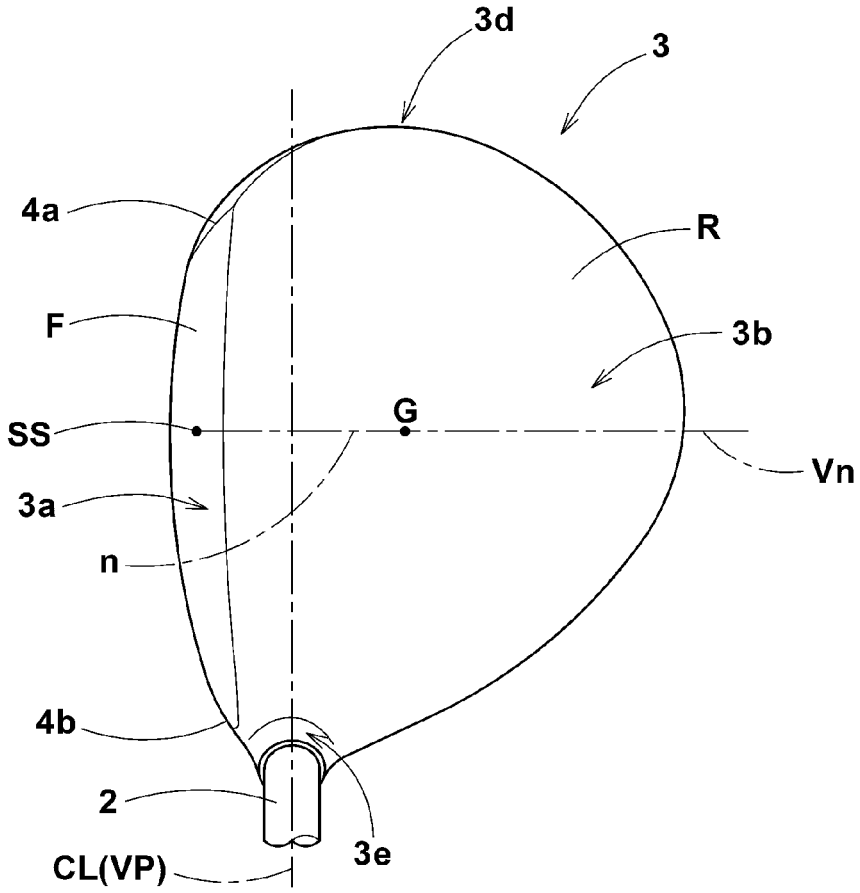
FIG. 3 is a top view of the golf club head.

As shown in FIG. 1, a golf club 1 according to the present invention comprises a club shaft 2, a golf club head 3 attached to the tip end 2A of the club shaft 2, and a grip 4 attached to the butt end 2B of the club shaft 2.

The loft angle is more than 0 degree.

The golf club 1 has a club length L of not less than 45.00 inches, preferably not less than 45.25 inches, more preferably not less than 45.5 inches, but not more than 47.00 inches, preferably not more than 46.75 inches, more preferably not more than 46.5 inches.

If the club length L is less than 45 inches, then it becomes difficult to increase the head speed and the carry distance by taking advantage of the club length. If the club length L is more than 47 inches, then the golfer tends to feel the club length and it becomes difficult to lessen the variation of the hitting positions.

Preferably, the club shaft 2 is made of a fiber reinforced resin because the club length can be increased without increasing the mass of the club shaft 2. Incidentally, in the case of a fiber reinforced resin, the club shaft 2 can be manufactured by a sheet winding method, a filament winding method, an internal pressure molding method or the like.

The club head 3 has a crown portion 3*b* defining the top surface of the club head 3, a sole portion 3*c* defining the bottom surface of the club head 3, a face portion 3*a* extending between the crown portion 3*b* and the sole portion 3*c* so as to form a club face F for hitting a ball, a side portion 3*d* extending between the crown portion 3*b* and the sole portion 3*c* and extending from the toe-side edge 4*a* of the club face F to the heel-side edge 4*b* of the club face F through the back face BF of the club head, and a tubular hosel portion 3*e* located at the heel-side end of the club head 3 and having a club shaft inserting hole into which the tip end of the club shaft 2 is inserted. Thus, the club head 3 is provided with a hollow (i) and a shell structure with a relatively thin wall.

The volume V of the club head 3 is set in a range of not less than 440 cu·cm, preferably not less than 445 cu·cm, more preferably not less than 450 cu·cm, but not more than 470 cu·cm, preferably not more than 465 cu·cm, more preferably not more than 460 cu·cm.

If the volume V is less than 440 cu·cm, the golfer tends to feel the smallness of the club head 3, and it becomes difficult to hit the ball at the sweet spot. As a results, the carry distance tends to vary or decrease. If the volume V is more than 470 cu·cm, the mass of the club head increases, and it becomes difficult to make a proper follow through. As a results, the head speed tends to decrease.

The mass of the club head 3 is preferably not less than 170 g, more preferably not less than 175 g, but preferably not more than 200 g, more preferably not more than 195 g.

If the mass of the club head 3 is less than 170 g, the kinetic energy of the club head becomes small, and it is difficult to increases the carry distance. If more than 200 g, it becomes difficult to make a proper follow through, and the directional stability and carry distance tend to become worse.

The moment of inertia M of the club head 3 around the club shaft center line CL is preferably set in a range of not less than 5500 g sq·cm, more preferably not less than 5700 g sq·cm, still more preferably not less than 5900 g sq·cm, but not more than 6500 g sq·cm, more preferably not more than 6300 g sq·cm, still more preferably not more than 6200 g sq·cm.

If the moment of inertia M exceeds 6500 g sq·cm, then in the swing, the club face F becomes hard to return to the proper address position, and the golfer tends to make a slice shot. If the moment of inertia M is less than 5500 g sq·cm, then the club face F returns over the proper address position, and the golfer tends to hook a ball.

The ratio M/V of the moment of inertia M (g sq·cm) to the volume V (cu·cm) of the golf club head is set in a range of not less than 11.0, preferably not less than 11.5, more preferably not less than 12.0, but not more than 13.5, preferably not more than 13.0, more preferably not more than 12.5. Thus, the ratio M/V is limited within a relatively narrow range. In other words, the moment of inertia M is set within a relatively narrow range which depends on the volume V of the club head 3. Thereby, it is possible to return the club face F to the proper address position.

If the ratio M/V is less than 11.0, a hook shot is liable to occur. If the ratio M/V is more than 13.5, a slice shot is liable to occur.

In this example, the side portion 3*d* of the club head 3 is formed by a main member 5 forming a major part of the side portion 3*d*, and a side toe member 6 attached to the main member 5 so as form a toe-side part of the side portion 3*d*.

The main member 5 is provided with a toe-side opening O1 and forms the rest of the side portion 3*d* excepting the toe-side opening O1. The toe-side opening O1 is closed by the side toe member 6.

The toe-side opening O1 has a shape approximate to the shape of the side toe member 6, preferably, a shape similar to the shape of the side toe member 6.

The main member 5 is provided around the toe-side opening O1 with a step 8 denting from the outer surface of the main member 5 in order that, when the side toe member 6 is fitted on the step, the periphery of the inner surface of the side toe member 6 is supported, and the outer surfaces of the side toe member 6 and the main member 5 become flush with each other.

The main member 5 is made of one or two or more kinds of metal materials having an excellent specific strength, for example, titanium alloy, stainless and the like.

In order to obtain the necessary specific strength and the necessary volume of the club head 3 at the same time, the specific gravity ρ2 of the metal material of the main member 5 is preferably set in a range of not less than 1.5, more preferably not less than 2.0, but not more than 10, more preferably not more than 8.0.

Incidentally, the specific gravity is the relative density with respect to water at 4 deg. C.

In the side view of the club head 3 viewed from the toe side, the side toe member 6 has a shape having a front edge, a rear edge and a lower edge which are substantially straight, and an upper edge which is convexly curved toward the upside.

The side toe member 6 is made of a material having a specific gravity ρ1 which is less than the specific gravity ρ2 of the main member 5.

Preferably, the specific gravity ρ1 is set in a range of not less than 0.5, more preferably not less than 1.0, but not more than 8.0, more preferably not more than 5.0.

Therefore, the mass distribution is effectively decreased on the toe-side of the club head, and the moment of inertia M can be set in the above-mentioned range.

In order to effectively derive such functions, the specific gravity ρ1 of the side toe member 6 is preferably set in a range of not more than 0.8 times, but not less than 0.23 times, more preferably not less than 0.35 times the specific gravity ρ2 of the main member 5.

As to the material of the side toe member 6, one or two or more kinds of materials, e.g. titanium alloys, aluminum alloys, magnesium alloys, fiber reinforced resins and the like can be used. But, the use of a fiber reinforced resin is especially preferred.

The fiber reinforced resin is a complex of reinforcing fiber and a matrix resin.

For example, a thermosetting resin such as epoxide resin and phenol resin, a thermoplastic resin such as nylon resin and polycarbonate resin or the like can be used as matrix resin.

As to the reinforcing fiber, for example, carbon fiber, glass fiber, organic fibers such as aramid fiber and polyphenylene benzoxazole resin fiber (PBO fiber), metal fibers such as amorphous fiber and titanium fiber and the like can be used. Especially, the use of carbon fiber is preferred.

The tensile elastic modulus of the reinforcing fiber is set in a range of not less than 147 GPa, preferably not less than 196 GPa, more preferably not less than 235 GPa, but not more than 490 GPa, preferably not more than 451 GPa.

If the tensile elastic modulus is less than 147 GPa, the side toe member 6 can not be provided with the necessary rigidity, and the durability tends to become insufficient. If the tensile elastic modulus is more than 490 GPa, the tensile strength tends to decrease and the production cost increases.

Here, the tensile elastic modulus is measured according to the Japanese Industrial standard JIS 87601 "Testing method for carbon fiber".

In the case that two or more kinds of fibers are used in combination, the following average tensile elastic modulus, in which the tensile elastic modulus of each kind of fiber is weighted by the mass ratio of the fiber, is used.

$$\text{Average tensile elastic modulus}=\Sigma(Ei-Vi)/\Sigma Vi$$

wherein, i is a suffix as integers from 1 to the number of the kinds of fibers, and Ei and Vi are the tensile elastic modulus and mass of each kind of fiber, respectively.

In the side view of the club head 3 viewed from the toe-side, the area Sa of the side toe member 6 is set in a range of not less than 10%, preferably not less than 15%, more preferably not less than 20%, but not more than 90%, preferably not more than 85%, more preferably not more than 80% of the overall area S of the side portion defined as being surrounded by the boundary line K (ridge line) between the side portion 3*d* and the crown portion 3*b*, the bottom face Bm of the club head, the above-mentioned toe-side edge 4*a* and the back face BF of the club head.

If the area Sa is more than 90% of the overall area S, the durability of the club head 3 tend to decrease. If the area Sa is less than 10% of the overall area S, it is difficult to decrease the moment of inertia M.

For similar reasons, the minimum height H of the side toe member 6 from the horizontal plane HP is preferably set in a range of not less than 20%, more preferably not less than 30%, but not more than 130%, more preferably not more than 120% of the height Hg of the center of gravity G of the club head 3 from the horizontal plane HP.

It is preferable that the portions of the club head 3 excepting the side portion 3*d*, specifically, the face portion 3*a*, crown portion 3*b*, sole portion 3*c* and hosel portion 3*e* are made of the same material as that of the main member 5, and are integrally formed by casting or the like.

However, it is of course possible to form these portions by assembling two or more parts separately prepared by suitable methods, e.g. forging, casting, press forming, rolling and the like and fixed to each other by welding, adhesive agent and the like.

In this example, since the main member 5 is made of a metal material and the side toe member 6 is made of a fiber reinforced resin, it is preferable that the side toe member 6 and the main member 5 are fixed to each other by the use of an adhesive agent.

Figure 4:
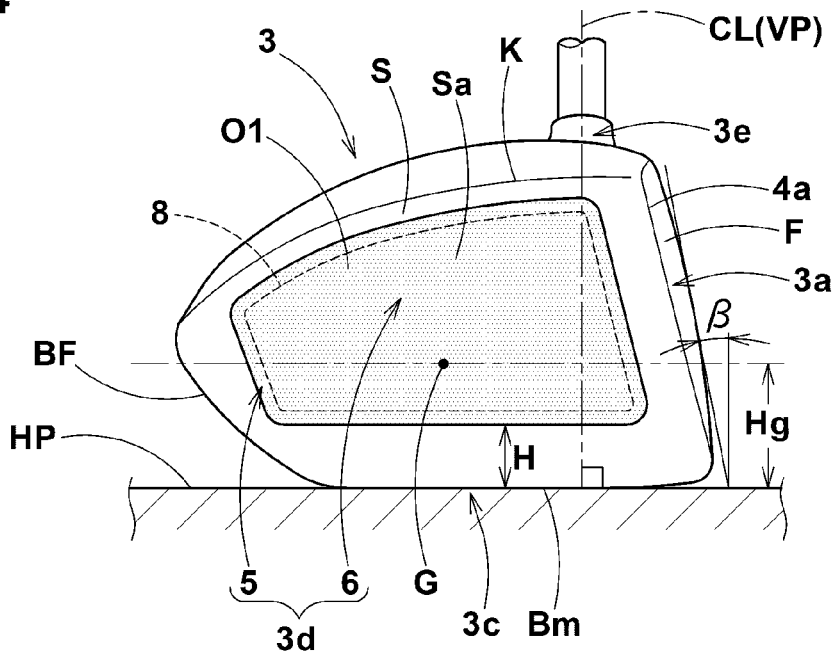
FIG. 4 is a side view of the golf club head viewed from the toe-side thereof.
Figure 5:
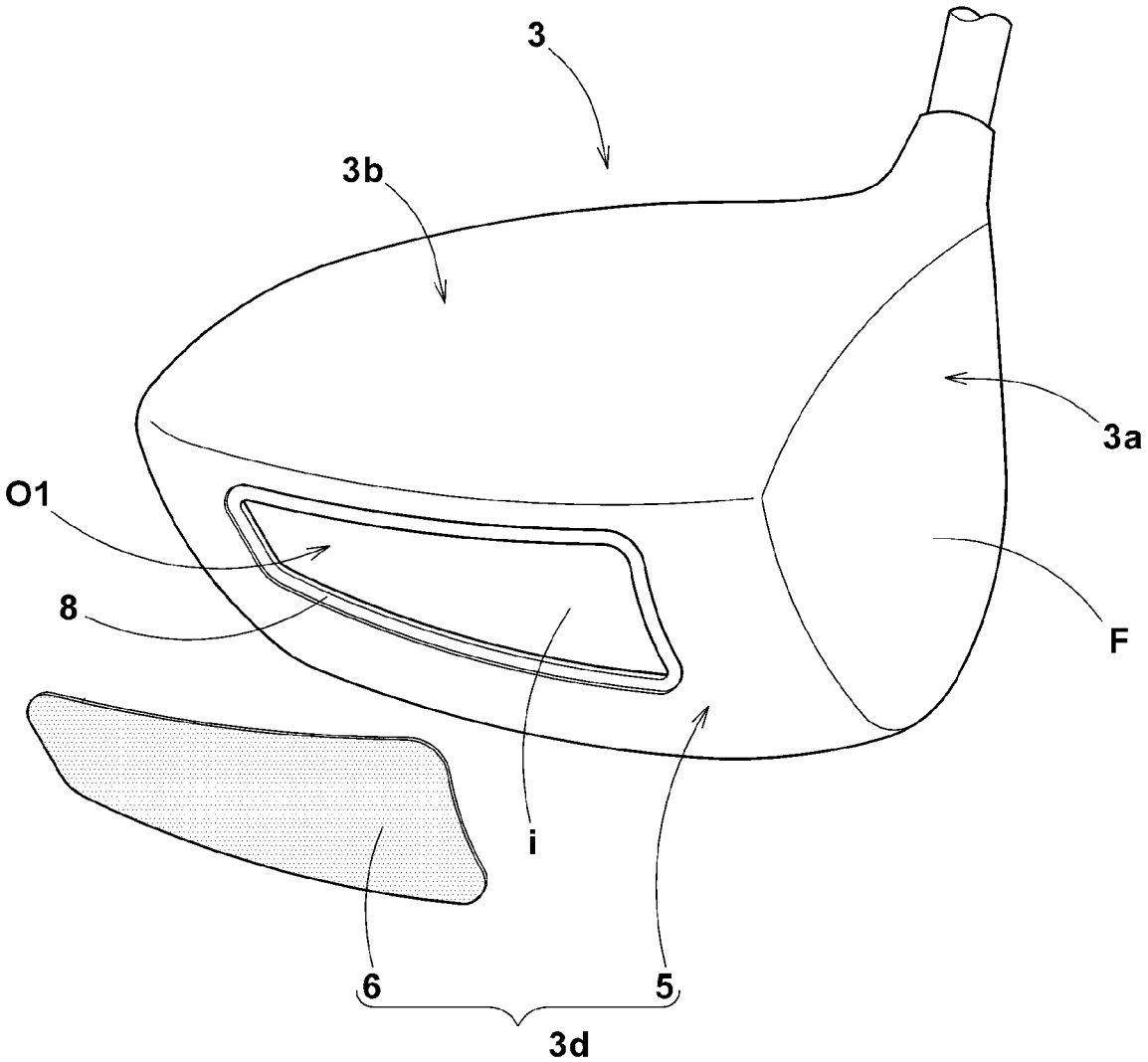
FIG. 5 is a exploded perspective view of the golf club head viewed from the toe-side.
Figure 6A:
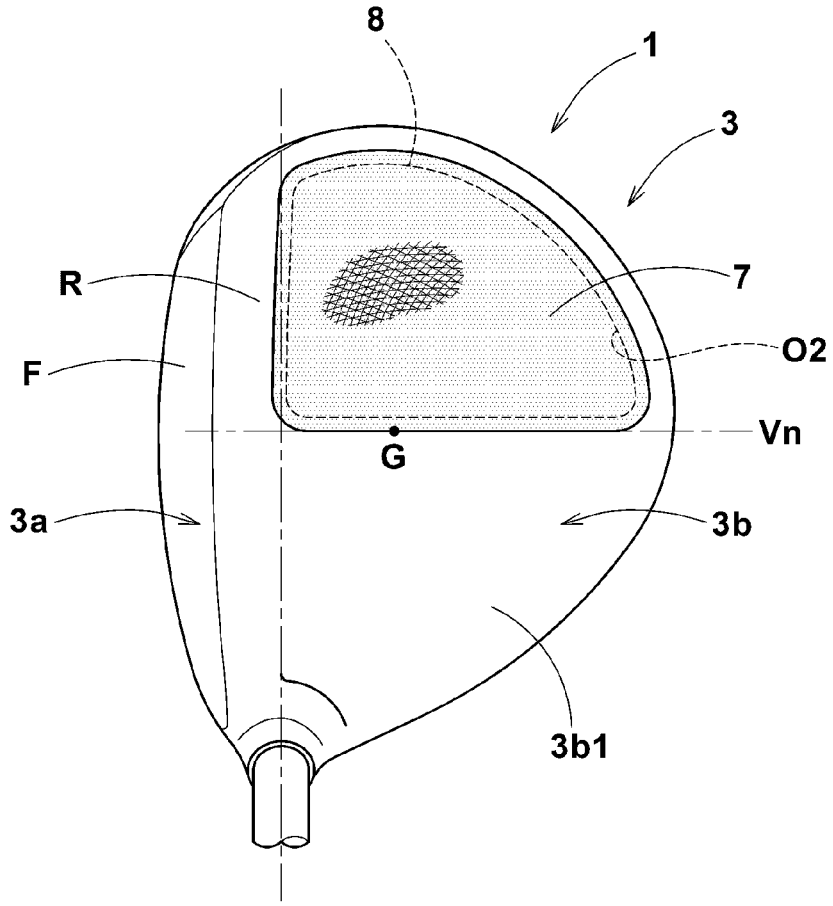
FIG. 6(*a*) is a top view of another embodiment of the present invention.
Figure 6B:
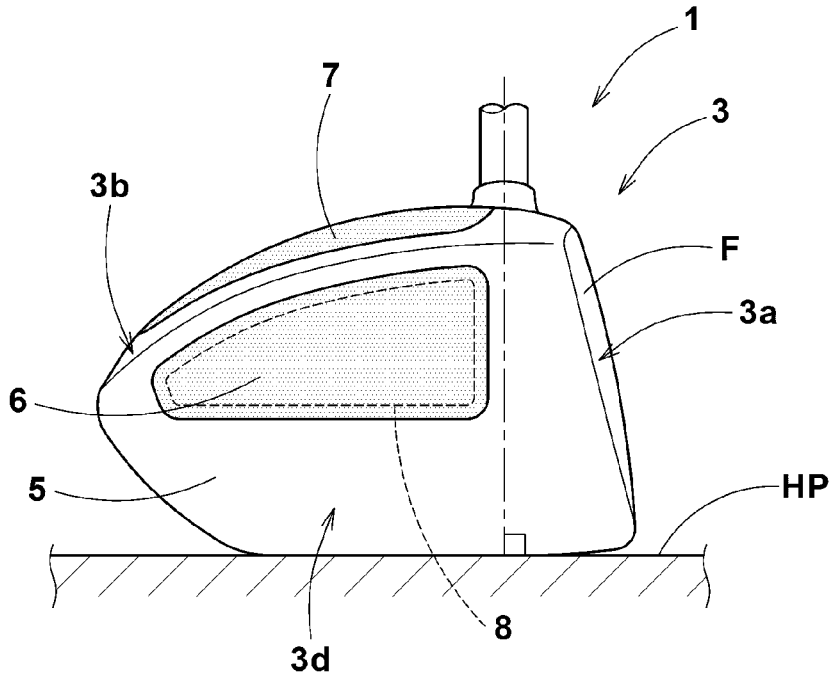

FIG. 6(*a*) and FIG. 6(*b*) show a modification of the club head shown in FIGS. 4 and 5, wherein the crown portion 3*b* of the club head 3 is formed by a crown main member 3*b*1 provided with a crown opening O2, and a crown toe member 7 closing the crown opening O2.

In this embodiment, the crown opening O2 is positioned within a toe-side part R of the crown portion 3*b*.

Here, the toe-side part R is defined as a part on the toe-side of a vertical plane vn including the above-mentioned straight line n drawn between the sweet spot SS and the center of gravity G of the head in the standard state.

The crown opening O2 has a shape approximate to the shape of the crown toe member 7, preferably, a shape similar to the shape of the crown toe member 7.

The crown main member 3*b*1 is provided around the crown opening O2 with a step 8 denting from the outer surface of the crown main member in order that, when the crown toe member 7 is fitted on the step, the periphery of the inner surface of the crown toe member is supported, and the outer surfaces of the crown toe member 7 and the crown main member 3*b*1 become flush with each other.

In the top view of the club head 3, the crown toe member 7 has a fan shape having a front edge extending substantially straight in the heel-and-toe direction, a inner edge extending substantially straight in the front-back direction, and a convexly curved side edge.

In this embodiment, the front edge is positioned near the above-mentioned vertical plane VP. The inner edge is positioned near the above-mentioned vertical plane Vn. The convexly curved side edge extends substantially parallel with the contour of the club head 3 in the top view of the club head.

Similarly to the above-mentioned side toe member 6, it is preferable that the crown toe member 7 is made of the fiber reinforced resin having the specific gravity ρ1.

Accordingly, the mass distribution is decreased on the toe-side of the crown portion. Therefore, the moment of inertia M can be further decreased, and also the position of the center of gravity of the club head 3 can be lowered.

Figure 7A:
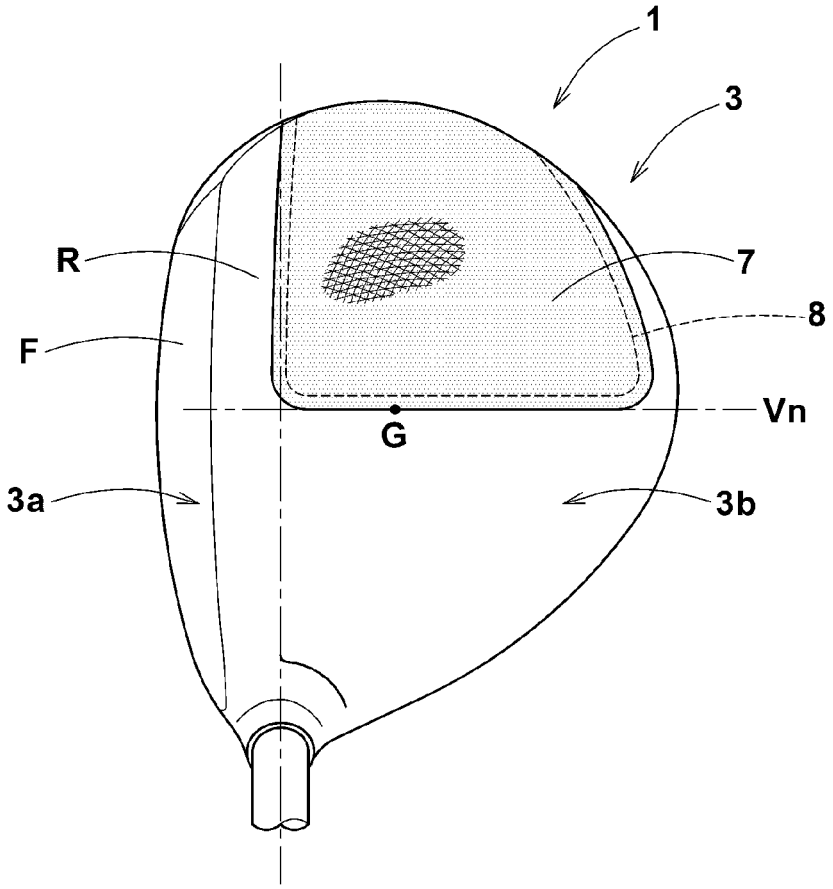
FIG. 7(*a*) is a top view of still another embodiment of the present invention.
Figure 7B:
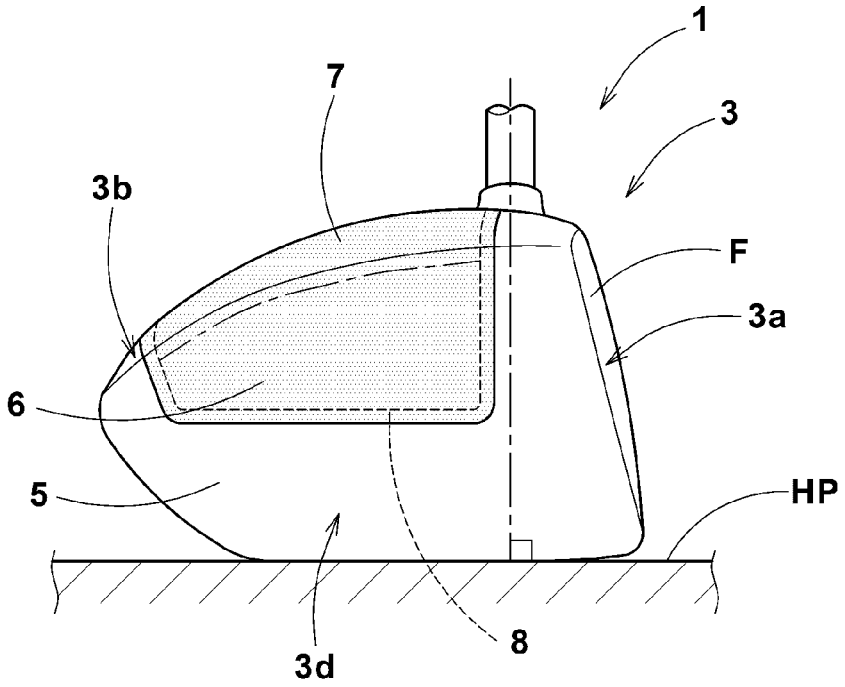

FIG. 7(*a*) and FIG. 7(*b*) show a modification of the golf club head shown in FIG. 6(*a*) and FIG. 6(*b*), wherein the side toe member 6 and the crown toe member 7 are extended to the above-mentioned boundary line K (ridge line), and these members 6 and 7 are united into one body.

Also the toe-side opening O1 and the crown opening O2 are extended to the boundary line K, and merged into one opening. Therefore, on the toe-side of the club head, the mass can be further decreased and the moment of inertia M can be further decreased.

However, in order to support the inner surface of the united side toe member 6 and crown toe member 7, it is possible to provide a frame extending across the opening along the boundary line K for example as shown in FIG. 7(*b*) by imaginary line. In this case, it is preferable that the frame has an almost constant width along its length, and the outer surface thereof dents to the same level as the above-mentioned step 8.

In the embodiment shown in FIGS. 4 and 5, the mass of the side toe member 6 is preferably set in a range of not less than 0.05 times, more preferably not less than 0.10 times, but not more than 0.30 times, more preferably not more than 0.25 times the mass of the club head 3.

In the embodiments shown in FIG. 6 and FIG. 7, the total mass of the side toe member 6 and crown toe member 7 is preferably set in a range of not less than 0.15 times, more preferably not less than 0.20 times, but not more than 0.35 times, more preferably not more than 0.30 times the mass of the club head 3.

Comparison Tests

Wood-type golf club heads (driver, lie angle alpha=58 degrees, loft angle beta=10 degrees) were prepared based on the specifications shown in Table 1, and tested for the directional stability and carry distance of the hit balls.

The club heads were first manufactured as a casting of titanium alloy Ti-6Al-4V (specific gravity ρ2=4.5). Then, according to the specifications, the toe-side opening and crown opening were formed and closed by the side toe member and crown toe member. The thickness of the face portion was 3.0 mm.

<Directional Stability and Carry Distance Test>

With respect to each golf club, fourteen golfers having handicap ranging from 3 to 25 hit three-piece balls (manufactured by SRI sports Limited and commercially available as "Hi-BRID everio") ten times per golfer, and the distance of the point of fall of the struck ball from the target trajectory was measured in each shot, where "+" plus sign and "−" minus sign indicating "slice" and "hook", respectively, were added to the measurements, and ten measurements obtained from each golfer were averaged, and then fourteen averaged values obtained from the fourteen golfers were averaged. Such averaged values are shown in Table 1, wherein the smaller the value, the better the directional stability.

Further, the average carry distance of each golfer was calculated, and then fourteen averaged values of the fourteen golfers were averaged. Such averaged values are shown in Table 1.

From the test results, it was confirmed that the golf clubs according to the present invention can be significantly improved in the directional stability and the carry distance.

TABLE 1

| Club | Conv. | Ref. 1 | Ref. 2 | Ref. 3 | Ref. 4 | Ex. 1 | Ex. 2 | Ref. 5 | Ref. 6 | Ex. 3 | Ex. 4 |
|---|---|---|---|---|---|---|---|---|---|---|---|
| club length L (inches) | 44 | 44 | 48 | 45 | 45 | 45 | 45 | 45 | 45 | 45 | 45 |
| golf club head (Fig.) | — | 5 | 5 | 5 | 5 | 5 | 6 | 6 | 7 | 7 | 5 |
| head volume V (cu · cm) | 430 | 460 | 460 | 430 | 440 | 450 | 470 | 480 | 460 | 460 | 460 |
| moment of inertia M (g sq · cm) | 6800 | 6000 | 6000 | 6000 | 6000 | 6000 | 6000 | 6000 | 5400 | 5500 | 6000 |
| ratio M/V | 15.8 | 13.0 | 13.0 | 14.0 | 13.6 | 13.3 | 12.8 | 12.5 | 11.7 | 12.0 | 13.0 |
| side toe member material *1 | — | C | C | C | C | C | D | D | B | B | D |
| mass ratio (side toe member/club head) | — | 0.12 | 0.12 | 0.19 | 0.16 | 0.14 | 0.10 | 0.09 | 0.05 | 0.07 | 0.12 |
| crown toe member material *1 | — | — | — | — | — | — | D | D | B | B | — |
| mass ratio (crown toe member/club head) | — | — | — | — | — | — | 0.10 | 0.09 | 0.05 | 0.07 | — |
| directional stability (m) | +15 | −3 | +7 | −1 | +1 | 0 | 0 | +3 | −15 | −5 | 0 |
| carry distance (m) | 190 | 190 | 196 | 194 | 196 | 200 | 204 | 197 | 196 | 203 | 202 |

| Club | Ref. 7 | Ref. 8 | Ref. 9 | Ref. 10 | Ex. 5 | Ex. 6 | Ref. 11 | Ref. 12 | Ex. 7 | Ex. 8 | Ref. 13 |
|---|---|---|---|---|---|---|---|---|---|---|---|
| club length L (inches) | 45 | 45 | 46 | 46 | 46 | 46 | 46 | 46 | 46 | 46 | 46 |
| golf club head (Fig.) | 5 | 5 | 5 | 5 | 5 | 6 | 6 | 7 | 7 | 5 | 5 |
| head volume V (cu · cm) | 460 | 460 | 430 | 440 | 450 | 470 | 480 | 460 | 460 | 460 | 460 |
| moment of inertia M (g sq · cm) | 6500 | 6600 | 6000 | 6000 | 6000 | 6000 | 6000 | 5400 | 5500 | 6000 | 6500 |
| ratio M/V | 14.1 | 14.3 | 14.0 | 13.6 | 13.3 | 12.8 | 12.5 | 11.7 | 12.0 | 13.0 | 14.1 |
| side toe member material *1 | C | C | C | C | C | D | D | B | B | D | C |
| mass ratio (side toe member/club head) | 0.20 | 0.22 | 0.19 | 0.16 | 0.14 | 0.10 | 0.09 | 0.05 | 0.07 | 0.12 | 0.20 |
| crown toe member material *1 | — | — | — | — | — | D | D | B | B | — | — |
| mass ratio (crown toe member/club head) | — | — | — | — | — | 0.10 | 0.09 | 0.05 | 0.07 | — | — |
| directional stability (m) | +10 | +15 | +3 | +3 | +3 | +3 | +4 | −13 | +1 | +3 | +9 |
| carry distance (m) | 190 | 191 | 195 | 195 | 206 | 210 | 194 | 195 | 209 | 208 | 196 |

| Club | Ref. 14 | Ref. 15 | Ref. 16 | Ex. 9 | Ex. 10 | Ref. 17 | Ref. 18 | Ex. 11 | Ex. 12 | Ref. 19 | Ref. 20 |
|---|---|---|---|---|---|---|---|---|---|---|---|
| club length L (inches) | 46 | 47 | 47 | 47 | 47 | 47 | 47 | 47 | 47 | 47 | 47 |
| golf club head (Fig.) | 5 | 5 | 5 | 5 | 6 | 6 | 7 | 7 | 5 | 5 | 5 |
| head volume V (cu · cm) | 460 | 430 | 440 | 450 | 470 | 480 | 460 | 460 | 460 | 460 | 460 |
| moment of inertia M (g sq · cm) | 6600 | 6000 | 6000 | 6000 | 6000 | 6000 | 5400 | 5500 | 6000 | 6500 | 6600 |
| ratio M/V | 14.3 | 14.0 | 13.6 | 13.3 | 12.8 | 12.5 | 11.7 | 12.0 | 13.0 | 14.1 | 14.3 |
| side toe member material *1 | C | C | C | C | D | D | B | B | D | C | C |
| mass ratio (side toe member/club head) | 0.22 | 0.19 | 0.16 | 0.14 | 0.10 | 0.09 | 0.05 | 0.07 | 0.12 | 0.20 | 0.22 |
| crown toe member material *1 | — | — | — | — | D | D | B | B | — | — | — |
| mass ratio (crown toe memberlclub head) | — | — | — | — | 0.10 | 0.09 | 0.05 | 0.07 | — | — | — |
| directional stability (m) | +17 | +14 | +8 | +5 | +5 | +7 | −12 | +2 | +5 | +12 | +14 |
| carry distance (m) | 205 | 196 | 202 | 211 | 215 | 202 | 205 | 213 | 212 | 206 | 205 |

*1 B: fiber reinforced resin (specific gravity 1.8) C: aluminum alloy (specific gravity 2.8) D: magnesium alloy (specific gravity 1.9)

The invention claimed is:

1. A golf club comprising a club shaft and a golf club head attached to the tip end of the club shaft, wherein the length of the golf club is from 45 to 47 inches, the volume V of the golf club head is from 440 to 470 cu·cm, the moment of inertia M of the golf club head around the center line of the club shaft is 5500 to 6500 g sq·cm, and the ratio M/V of the moment of inertia M (g sq·cm) to the volume V (cu·cm) is from 11.0 to 13.5, and said golf club head comprises a face portion having a club face for hitting a ball, a crown portion defining the top surface of the golf club head, a sole portion defining the bottom surface of the golf club head, and a side portion between the crown portion and sole portion, extending from a toe-side edge of the club face to a heel-side edge of the club face through a back face of the golf club head, and provided with a toe-side opening, which portions are made of a material having a specific gravity ρ2, and wherein said side portion is provided with a toe-side opening and a side toe member closing said toe-side opening and forming a toe-side part of the side portion, said side toe member being made of a material having a specific gravity ρ1 which is less than 1.0 times but not less than 0.23 times the specific gravity ρ2.

2. The golf club head according to claim 1, wherein the material of the side toe member is a fiber reinforced resin.

3. The golf club head according to claim 1, wherein the golf club head is a wood-type golf club head.

4. A golf club comprising a club shaft and a golf club head attached to the tip end of the club shaft, wherein the length of the golf club is from 45 to 47 inches, the volume V of the golf club head is from 440 to 470 cu·cm, the moment of inertia M of the golf club head around the center line of the club shaft is 5500 to 6500 g sq·cm, the ratio M/V of the moment of inertia M (g sq·cm) to the volume V (cu·cm) is from 11.0 to 13.5, and said golf club head comprises a face portion having a club face for hitting a ball, a crown portion defining the top surface of the golf club head, a sole portion defining the bottom surface of the golf club head, and a side portion between the crown portion and sole portion, which extends from a toe-side edge of the club face to a heel-side edge of the club face through a back face of the golf club head, the side portion being formed by a side toe member forming a toe-side part of the side portion, and a main member forming the rest of the side portion excepting said toe-side part, wherein the main member is made of a material having a specific gravity ρ2, and the side toe member is made of a material having a specific gravity ρ1 which is less than 1.0 times but not less than 0.23 times the specific gravity ρ2, the crown portion is formed by, and a crown toe member forming a toe-side part of the crown portion, and a crown main member forming the rest of the crown portion excepting said toe-side part, wherein the crown toe member has a specific gravity less than that of the crown main member, and the crown toe member and the side toe member are separated.

5. The golf club head according to claim 4, wherein the crown toe member is made of a fiber reinforced resin.

6. The golf club head according to claim 4, wherein the material of the side toe member is a fiber reinforced resin.

7. The golf club head according to claim 4, wherein the golf club head is a wood-type golf club head.

8. A golf club comprising a club shaft and a golf club head attached to the tip end of the club shaft, wherein the length of the golf club is from 45 to 47 inches, the volume V of the golf club head is from 440 to 470 cu·cm, the moment of inertia M of the golf club head around the center line of the club shaft is 5500 to 6500 g sq·cm, the ratio M/V of the moment of inertia M (g sq·cm) to the volume V (cu·cm) is from 11.0 to 13.5, and said golf club head comprises a face portion having a club face for hitting a ball, a crown portion defining the top surface of the golf club head, a sole portion defining the bottom surface of the golf club head, and a side portion between the crown portion and sole portion, which extends from a toe-side edge of the club face to a heel-side edge of the club face through a back face of the golf club head, the side portion being formed by a side toe member forming a toe-side part of the side portion, and a main member forming a major part of the side portion excepting the toe-side part, wherein the main member is made of a material having a specific gravity ρ2, and the side toe member is made of a material having a specific gravity ρ1 which is less than 1.0 times but not less than 0.23 times the specific gravity ρ2, and wherein the crown portion is formed by a crown toe member forming a toe-side part of the crown portion, and a crown main member forming a major part of the crown portion excepting the toe-side part, wherein the crown toe member has a specific gravity less than that of the crown main member, and the crown toe member and the side toe member are united into one body.

9. The golf club head according to claim 8, wherein the crown toe member is made of a fiber reinforced resin.

10. The golf club head according to claim 8, wherein the material of the side toe member is a fiber reinforced resin.

11. The golf club head according to claim 8, wherein the golf club head is a wood-type golf club head.

* * * * *